United States Patent [19]

Shepley

[11] 4,426,298

[45] Jan. 17, 1984

[54] TEXTILE PROCESSING OILS

[75] Inventor: John D. Shepley, Amsterdam, Netherlands

[73] Assignee: Shell Oil Company, Houston, Tex.

[21] Appl. No.: 444,141

[22] Filed: Nov. 24, 1982

[30] Foreign Application Priority Data

Nov. 27, 1981 [GB] United Kingdom ..... 8135819

[51] Int. Cl.[3] ..... D06M 13/18

[52] U.S. Cl. ..... 252/8.9; 252/52 A

[58] Field of Search ..... 252/52 A, 8.9

[56] References Cited

U.S. PATENT DOCUMENTS 3,619,234 11/1971 Weihsbach et al. ..... 252/8.9

4,134,841 1/1979 Park et al. ..... 252/8.9

*Primary Examiner*—Maria Parrish Tungol

[57] ABSTRACT

A textile processing oil, characterized by a high degree of compatibility with both oil and water, comprises:

(a) between about 50 and 88 parts by weight of a mixture of alcohol ethoxylates of the formula $C_nH_{2n+1}—O—CH_2—CH_2—_mOH$ wherein n is in the range from 9 to 11 inclusive and m has an average value in the range from 5 to 7 inclusive, (b) between about 12 and 32 parts by weight of a mixture of alcohol propoxylates of the formula $C_pH_{2p+1}—O—CH_2—CH_2—_qOH$ wherein p is in the range from 12 to 15 inclusive and q has an average value in the range from 5 to 6 inclusive, and (c) between 0 and about 28 parts by weight of a copoly(ethoxylate propoxylate) mono $C_1$ to $C_6$ alkyl ether having an ethoxylate to propoxylate weight ratio between 30 to 70 and 5 to 95, the sum of the individual parts by weight of (a), (b), and (c) totaling 100. The compositions are particularly useful in processes for the scouring of wool.

9 Claims, No Drawings

TEXTILE PROCESSING OILS

BACKGROUND OF THE INVENTION

The present invention relates to textile processing oils as well as to a process for facilitating the processability of fibers or fibrous materials, more particularly to facilitating processability in the woollen and worsted systems of textile processing.

In the textile industry, textile processing oils are used as processing aids in order to facilitate the various processing steps in which textile fibers (or fibrous material prior to fiber processing) are converted into textile goods such as yarn, woven or non-woven cloth, knitted goods, felts, carpets, rugs, twine and sewing threads. The woollen and worsted industries have evolved rather distinct systems for processing the raw, fibrous materials and this gives rise to the characteristic differences between woollens and worsteds. Although wool was the original raw material for both the woollen and worsted industry, both now use other raw materials either alone or together with wool; therefore the terms "woollen system" and "worsted system" may indicate the manufacturing technique applied instead of the material used. In the woollen system the principal reason for using a processing oil is to facilitate carding and various stages of spinning, and in the worsted system it is to facilitate combing.

Traditionally, vegetable and animal oils as well as some mineral oil-based lubricants have been used in the worsted system but more versatile textile oils which can be used in both systems have been developed. Of particular relevance to the invention are compositions disclosed in U.S. Pat. No. 4,134,841 and in British patent specification No. 1,172,719. The U.S. patent discloses a polyoxyalkylene compound, particularly a copoly(oxyethyleneoxypropylene)butyl monoether, and a non-hindered polyphenol stabilizer. The British patent specification discloses textile oils based on condensation products having a melting point below 12° C. and having been prepared by reacting one or more 1,2-alkylene oxides with two or three carbon atoms with a mixture of monohydric saturated aliphatic primary or secondary alcohols with 8 to 18 carbon atoms, this mixture comprising at least 60% by weight of linear, straight chain alcohols. Although such textile processing oils of the prior art can be used with some success, they are not capable of achieving the delicate balance between miscibility with water on the one hand and miscibility with oil on the other, which is in many cases desirable. The need remains for more sophisticated textile processing oils, especially for use in woollen systems and particularly in applications for the processing of greasy wool containing raw materials, which are highly compatible with both water and oil.

SUMMARY OF THE INVENTION

It has now been found that a composition combining three particular ingredients in critical proportions has the attributes generally desirable for its application as a textile processing oil, as well as the specific property of high compatibility for both the water and the oil components of the fiber processing environment.

The present invention is, therefore, in the one aspect a textile processing oil comprising (a) between about 50 and 88 parts by weight of a mixture of alcohol ethoxylates of the formula $C_nH_{n+1}$-(O—$CH_2CH_2$)-$_m$OH, for which n is in the range from 9 to 11 inclusive and m has an average value in the range from 5 to 7 inclusive, (b) between about 12 and 32 parts by weight of a mixture of alcohol propoxylates of the formula $C_pH_{2p+1}$-(O—CH($CH_3$)-$_q$OH, for which p is in the range from 12 to 15 inclusive and q has an average value in the range from 5 to 6 inclusive, and (c) between 0 and about 28 parts by weight of one or more copoly(ethoxylate propoxylate) mono $C_1$ to $C_6$ alkyl ethers having an ethoxylate to propoxylate weight ratio between about 30 to 70 and 5 to 95, the sum of the individual parts by weight of (a), (b), and (c) totaling 100.

Both the specific identity of each of the three ingredients, and also the relative proportions of each ingredient to the other two in the composition have been found to be critical to realizing the desired compatibility in the water and oil environment of the common textile processing systems.

In another aspect, the present invention is the improvement in the process in which an alkylene oxide condensation product is applied to textile fibers or fibrous materials for manufacture in accordance with the woollen system or the worsted system, said improvement comprising applying to the textile fibers or fibrous materials the processing oil of high water and oil compatibility described hereinabove.

DESCRIPTION OF THE PREFERRED EMBODIMENTS

One preferred class of textile oils according to this invention are compositions comprising 50 to 80 parts by weight of the alcohol ethoxylate identified as component (a) wherein m is about 6, 12 to 32 parts of the alcohol propoxylate identified as component (b), and 0 to 18 parts of ether identified as component (c) wherein the ethoxylate to propoxylate weight ratio is between about 25 to 75 and 10 to 90, more preferably about 15 to 85.

Another particularly preferred class of textile processing oils are compositions comprising 60 to 70 parts by weight of the alcohol ethoxylate (a) wherein m is about 7, 22 to 30 parts of the alcohol propoxylate identified as component (b), and 4 to 10 parts of the ether identified as component (c) having an ethoxylate to propoxylate weight ratio between about 30 to 70 and 5 to 95, more preferably 5 to 10 parts of the ether having an ethoxylate to propoxylate ratio between about 25 to 75 and 5 to 95, most preferably about 15 to 85.

Still another preferred class of textile processing oils are compositions comprising 50 to 60 parts by weight of the alcohol ethoxylate (a) wherein m is about 5, 20 to 25 parts of the alcohol propoxylate (b), and 20 to 25 parts of the ether (c) wherein the ethoxylate to propoxylate weight ratio is between 25 to 75 and 5 to 95, more preferably about 15 to 85.

It is to be understood that in describing the parts by weight of individual components (a), (b), and (c) for purposes of this invention, it is intended that the sum of the parts by weight of the three totals 100 parts. It is further to be understood that it is the ratio of these components in the composition, and not the absolute concentration which is important. Thus, the invention is intended to include compositions comprising the specified components in the specified proportions and, optionally, also containing other ingredients useful in the processing systems. For instance, it has been found that the presence of water has a beneficial effect on the stability of the textile processing oils according to the present invention. Quantities of water up to 20 parts by weight (pbw) (calculated on the basis of, but in addition to, the 100 parts of the textile processing oil components as defined hereinabove), preferably between 5 and 15 pbw may be present in the textile processing oils when prepared in concentrate form. It will further be appreciated that during some of the stages in the conversion of fibers or fibrous materials into textile goods the textile processing oils will be operated in a water-rich environment, and that compositions comprising substantial quantities of water are also intended to come within the scope of the invention. One of the important performance criteria for textile processing oils is their miscibility with rather varying amounts of water, while maintaining miscibility with oil at the same time.

As another useful ingredient, the textile processing oils may also contain a small amount of an oxiation inhibitor. Amounts up to 5 pbw (calculated on the basis of the same said 100 parts of components (a), (b), and (c)) can be suitably applied. Preference is given to the use of oxidation inhibitors in the range of from 0.05 to 2 pbw, in particular between 0.075 and 0.2 pbw. Examples of suitable oxidation inhibitors comprise: hydroquinone, 2,2-bis(4-hydroxyphenyl)propane, 2,2-(4-hydroxyphenyl, 2'-hydroxyphenyl)propane, 2,6-di-tert. butylphenol, 2,6-di-tert.butyl 4-methyl phenol, 2,6-di-tert.butyl 4-hydroxymethylphenol, trisphenol, triphenylolpropane and 2,2',2''-triphenylolethane.

Because of its compatibility with both water and oil, compositions in accordance with the invention may further contain one or more oils, such as mineral oils, castor/sperm oils or olefins, as have been used conventionally as textile processing oils, although limited quantities of such oils are preferred in order to maintain high compatibility with water and oil throughout the processing.

Alcohol ethoxylates and alcohol propoxylates useful for purposes of this invention are well known surface active agents and are commercially available from a variety of sources. They may be prepared by conventional oxyalkylation of alcohols, particularly primary or secondary (preferably primary) monohydric saturated aliphatic alcohols (alkanols) in the appropriate carbon number range, i.e., $C_9$ to $C_{11}$ inclusive for the ethoxylates and $C_{12}$ to $C_{15}$ inclusive for the propoxylates. Oxyalkylation is suitably accomplished, for example, by contact of a primary alcohol with ethylene oxide (for the ethoxylate) or propylene oxide (for the propoxylate) in the amount necessary to give the desired average m or q value, at a temperature of about 150° C., in the presence of a basic catalyst, e.g., NaOH or KOH. For oxyalkylation of a secondary alcohol it is typically necessary to carry out the reaction first in the presence of an acidic catalyst, e.g., a Lewis acid such as $BF_3$, to produce an ethoxylate or propoxylate for which m or q is between about 1 and 3. Further ethoxylation or propoxylation is then carried out, if desired, using the basic catalyst. Alcohols suitable for use in synthesis of the ethoxylates and propoxylates are also well known and commercially available, for instance as NEODOL 91 and NEODOL 25 Alcohols (trademark of and marketed by Shell Chemical Company).

The $C_nH_{2n+1}$ alkyl portion of the ethoxylated molecule and the $CpH_{2p+1}$ alkyl portion of the propoxylate molecule are preferably of linear (straight chain) structure. More preferably at least about 70% and most preferably at least about 80% of the alkyl portions of the ethoxylates and of the propoxylates are linear.

Suitable copoly(ethoxylate propoxylate) mono $C_1$–$C_6$ alkyl ethers preferably comprise compounds having a total of between about 5 and 20 oxyethylene and between about 20 and 50 oxypropylene units per molecule. More preferred are the monobutyl ethers, particularly the monobutyl ethers having from about 5 to 15 oxyethylene and from about 30 to 50 oxypropylene groups per molecule. The weight ratio of oxyethylene to oxypropylene groups is suitably between 30 to 70 and 5 to 95, with preference given to the lower ratios within this range, e.g., 20 to 80 to 10 to 90, to obtain textile processing oils of high stability. The presence of these copoly(ethoxylate propoxylate mono $C_1$–$C_6$ alkyl ethers) is not critical to the invention, as is the presence of the other two components. However, it is preferred, in limited amounts up to about 28 parts by weight, particularly between about 5 to 18 parts by weight, to improve stability of the overall composition. Preparation of component (c) can very conveniently be made applying oxyalkylation procedures as described for the preparation of components (a) and (b), utilizing a $C_1$ to $C_6$ alcohol reactant.

The textile processing oils according to the present invention can be applied both in the woollen and in the worsted system and are of particular interest in removing grease and/or oil in woolen systems using operations such as scouring the fibers and/or the yarns produced thereof. During the scouring procedure, the fibers are contacted or washed with a processing oil or with one or more aqueous solutions thereof to solubilize and remove wool grease and other impurities from the fibers.

The invention will now be illustrated by means of the following Examples.

COMPATIBILITY EXPERIMENTS

The compatibility of textile processing oils with water was determined by blending the appropriate textile processing oil with demineralized water so as to obtain blends containing 25 percent by weight (%w) water (blend A), 50%w water (B) and 75%w water (C), respectively. The physical appearance of each of the resulting blends was assessed 24 hours after the mixing had taken place. The compatibility (miscibility) with oils was determined by blending with a commercially available HVI 60 oil so as to obtain blends containing 50% oil (D) and 25% oil (E), respectively. Again, the blends were rated with respect to physical appearance after 24 hours at room temperature.

EXAMPLE 1

Seven textile processing oils (five of which were in accordance with the invention and two of which were not) were prepared by blending in different proportions (I) a mixture of alcohol ethoxylates of the formula $C_nH_{2n+1}$-(O—$CH_2CH_2$)-$_m$OH, wherein n was in the range from 9 to 11 and m had an average value of about 6, (II) a mixture of alcohol propoxylates of the formula $C_pH_{2p+1}$-(O—CH($CH_3$—$CH_2$)-$_q$OH, wherein p was in the range from 12 to 15 and q had an average value between 5 and 6, (III) a copoly(ethoxylate propoxylate) monobutyl ether having an average molecular weight of 3050, an ethoxylate to propoxylate ratio of 15 to 85, and a viscosity of 140 cS at 100° F. Also added to each such blend was 0.075 pbw (calculated on 100 pbw of I, II, and III) of 2,2-bis(4-hydroxyphenol)propane as oxidation inhibitor. Compositions of the oils and results of the compatibility testing of the seven blends are presented in Table 1.

TABLE 1

| Experiment No. | Textile Oil Composition (pbw) I | II | III |
|---|---|---|---|
| 1 | 86 | 12 | 2 |
| 2 | 80 | 18 | 2 |
| 3 | 80 | 13 | 7 |
| 4 | 70 | 20 | 10 |
| 5 | 60 | 26 | 14 |
| 6* | 45 | 37 | 18 |
| 7* | 45 | 27.5 | 27.5 |

*not in accordance with the invention.

| Experiment No. | Compatibility With Water A | B | C | Compatibility With Oil D | E |
|---|---|---|---|---|---|
| 1 | c | c | c | m | m |
| 2 | c | c | c | m | m |
| 3 | c | c | c | m | m |
| 4 | c | c | c | m | m |
| 5 | c | c | c | m | m |
| 6* | sep | sep | c | m | m |
| 7* | sep | sep | c | sep | m |

c = clear liquid
m = miscible
sep = separate layers

EXAMPLE 2

Textile processing oils were made up as described in Example 1, with the difference that component I was replaced by a mixture of alcohol ethoxylates for which n was in the range from 9 to 11 and m had an average value of 7. The compositions of the oils and results of compatibility testing are presented in Table 2.

TABLE 2

| Experiment No. | Textile Oil Composition (pbw) IV | II | III |
|---|---|---|---|
| 8* | 90 | 5 | 5 |
| 9* | 80 | 10 | 10 |
| 10 | 70 | 24 | 6 |
| 11 | 70 | 22.5 | 7.5 |
| 12* | 70 | 10 | 20 |
| 13* | 60 | 36 | 4 |
| 14 | 60 | 30 | 10 |

*= not in accordance with the invention

| Experiment No. | Compatibility With Water A | B | C | Compatibility With Oil D | E |
|---|---|---|---|---|---|
| 8* | c | c | c | sep | sep |
| 9* | c | c | c | sep | sep |
| 10 | c | c | c | m | m |
| 11 | c | c | c | m | m |
| 12* | c | c | c | sep | sep |
| 13* | c | sep | sep | m | m |
| 14 | c | c | c | m | m |

c = clear liquid
m = miscible
sep = separate layers

EXAMPLE 3

Textile processing oils were made up as described in Example 1, with the difference that compound I was replaced by a mixture of alcohol ethoxylates for which n was in the range from 9 to 11 and m had an average value of 5. The compositions of the oils and results of compatibility testing are presented in Table 3.

TABLE 3

| Experiment No. | Textile Oil Composition (pbw) V | II | III |
|---|---|---|---|
| 15 | 60 | 20 | 20 |
| 16* | 50 | 38 | 12 |
| 17 | 50 | 25 | 25 |

*= not according to the invention

| Experiment No. | Compatibility With Water A | B | C | Compatibility With Oil D | E |
|---|---|---|---|---|---|
| 15 | c | c | c | m | m |
| 16* | sep | g | g | m | m |
| 17 | c | c | c | m | m |

c = clear
m = miscible
sep = separate layers

EXAMPLE 4

A textile processing oil was made up by blending 80 pbw of compound I, 20 pbw of compound II and 0 pbw of compound III. To this mixture were added water (5 pbw, calculated on 100 pbw of I and II) and 2,2-bis(4-hydroxyphenyl)propane (0.075 pbw, calculated on the same basis). The physical appearance of the blend was assessed after the mixture was maintained for three days at 20° C. The textile processing oil was a clear liquid which was fully miscible with lanolin (refined wool grease) in a 3/1 weight ratio. When a similar blend was prepared based on I and II in a weight ratio 40/60, thus not in accordance with the invention, it had a hazy appearance after three days at 20° C.

EXAMPLE 5

The application of the textile processing oil described in experiment 5 of Example 1 was tested on yarns made from a greasy wool/nylon blend to which was added 5% by weight (on wool/nylon) blend of the textile processing oil. No difficulties were encountered in carding or spinning of the yarns. Yarns thus prepared and having, before scouring, an extractable residue of 6.4%w (in dichloromethane) were scoured using a standard nonionic neutral scouring procedure. The extractable residue was reduced to 0.4%w.

EXAMPLE 6

The application of the textile processing oil in accordance with the invention, described in Example 4, was tested in the manufacture of woollen cloth from greasy English and New Zealand wools. The textile processing oil was added in an amount of 5% by weight on wool. No difficulties were encountered in carding or spinning the yarns. Cloth thus prepared having, before scouring, an extractable residue of 7.8%w (in dichloromethane) was scoured using a standard solvent/detergent blend, soap and soda ash scouring procedure. The extractable residue was reduced to 0.2%w. Cloth was also scoured using soap, reduced quantities of soda ash and no solvent/detergent blend. An extractable residue was only 0.2%w.

I claim as my invention:

1. A composition useful in the processing of textiles, which comprises (a) between about 50 and 88 parts by weight of a mixture of alcohol ethoxylates of the formula $C_nH_{2n+1}$-(O—$CH_2$—$CH_2$)-$_m$OH wherein n is in the range from 9 to 11 inclusive and m has an average value in the range from 5 to 7 inclusive, (b) between about 12 and 32 parts by weight of a mixture of alcohol propoxylates of the formula $C_pH_{2p+1}$-(O—CH($CH_3$)—$CH_2$)-$_q$OH wherein p is in the range from 12 to 15 inclusive and q has an average value in the range from 5 to 6 inclusive, and (c) between 0 and about 28 parts by weight of a copoly(ethoxylate propoxylate) mono $C_1$ to $C_6$ alkyl ether having an ethoxylate to propoxylate weight ratio between 30 to 70 and 5 to 95, the sum of the individual parts by weight of (a), (b), and (c) totaling 100.

2. A composition according to claim 1, wherein component (a) is present in an amount between about 50 and 80 parts by weight and has an average value for m of about 6, and component (c) is a $C_3$ to $C_5$ alkyl ether present in an amount between 0 and about 18 parts by weight and has an ethoxylate to propoxylate weight ratio between 25 to 75 and 10 to 90.

3. A composition according to claim 2, wherein component (c) is a monobutylether present in an amount between 2 and 16 parts by weight and has an ethoxylate to propoxylate weight ratio of about 15 to 85.

4. A composition according to claim 1, wherein (a) is present in an amount between about 60 and 70 parts by weight and has an average value for m of about 7, (b) is present in an amount between about 22 and 30 parts by weight, and (c) is present in an amount between about 4 and 10 parts by weight.

5. A composition according to claim 4, wherein (c) is present in an amount between about 5 and 10 parts by weight and has an ethoxylate to propoxylate ratio between about 25 to 75 and 5 to 95.

6. A composition according to claim 1, wherein (a) is present in an amount between about 50 and 60 parts by weight and has an average value for m of about 5, (b) is present in an amount between about 20 and 25 parts by weight, and (c) is present in an amount between about 20 and 25 parts by weight and has an ethoxylate to propoxylate ratio between about 25 to 75 and 5 to 95.

7. The composition according to claim 6, wherein (c) is a monobutylether having an ethoxylate to propoxylate weight ratio of about 15 to 85.

8. In a process for facilitating the processability of textile fibers or fibrous materials which comprises applying thereto a textile processing oil, the improvement which comprises applying the composition described in claim 1.

9. In a process for scouring wool fibers which comprises a step for contacting the fibers with a textile processing oil, the improvement which comprises contacting the fibers with the composition described in claim 1.

* * * * *